US006649574B2

(12) United States Patent
Cardis et al.

(10) Patent No.: US 6,649,574 B2
(45) Date of Patent: Nov. 18, 2003

(54) BIODEGRADABLE NON-TOXIC GEAR OIL

(75) Inventors: Angeline Baird Cardis, Florence, NJ (US); Susan Ardito, Ocean, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/266,385

(22) Filed: Oct. 8, 2002

(65) Prior Publication Data

US 2003/0125218 A1 Jul. 3, 2003

Related U.S. Application Data

(60) Provisional application No. 60/328,321, filed on Oct. 10, 2001.

(51) Int. Cl.[7] ..... C10M 105/44; C10M 169/04

(52) U.S. Cl. ..... 508/280; 508/269; 508/288; 508/459; 508/463; 508/485; 508/492; 508/493; 508/551

(58) Field of Search ..... 508/269, 280, 508/288, 459, 463, 485, 492, 493, 551

(56) References Cited

U.S. PATENT DOCUMENTS

| | | | | |
|---|---|---|---|---|
| 5,397,487 | A | 3/1995 | Pillon et al. | 252/51.5 |
| 5,560,850 | A | 10/1996 | Hoppe et al. | 508/485 |
| 5,681,800 | A | 10/1997 | Duncan et al. | 508/485 |
| 5,728,658 | A | 3/1998 | Duncan | 508/485 |
| 5,733,853 | A | 3/1998 | Bardasz et al. | 508/485 |
| 5,767,047 | A | 6/1998 | Duncan et al. | 508/485 |
| 5,817,607 | A | 10/1998 | Duncan et al. | 508/485 |
| 5,942,474 | A | 8/1999 | Tiffany et al. | 508/485 |
| 5,994,278 | A | 11/1999 | Duncan et al. | 508/485 |
| 6,043,199 | A | 3/2000 | Godici | 508/285 |
| 6,177,387 | B1 | 1/2001 | Schlosberg et al. | 508/485 |
| 6,436,881 | B1 | 8/2002 | McHenry et al. | 508/280 |
| 6,468,319 | B1 | 10/2002 | Yeh et al. | 44/388 |

FOREIGN PATENT DOCUMENTS

| | | | |
|---|---|---|---|
| EP | 0330522 | 8/1989 | C10M/161/00 |
| WO | 93/25628 | 12/1993 | |
| WO | 96/17908 | 6/1996 | C10M/105/38 |
| WO | 96/17910 | 6/1996 | C10M/105/38 |
| WO | 97/44416 | 11/1997 | C10M/105/38 |
| WO | 98/10039 | 3/1998 | C10M/105/42 |

*Primary Examiner*—Jacqueline V. Howard
(74) *Attorney, Agent, or Firm*—Norby L. Foss; James A. Zboray

(57) ABSTRACT

A biodegradable lubricating oil composition especially useful as a gear oil employs a synthetic alcohol ester basestock formed from mono- and dipentaerythritol with certain mono- and dicarboxylic acids or dicarboxylic acid anhydrides and an effective amount of a polyoxyalkylene alcohol demulsifying agent, a combination of alkylated organic acid and ashless succinimide rust inhibitors and an ashless dithiocarbamate antiwear and extreme pressure agent.

10 Claims, No Drawings

BIODEGRADABLE NON-TOXIC GEAR OIL

CROSS-REFERENCE TO RELATED APPLICATION(S)

Non-Provisional Application based on Provisional Application No. 60/328,321 filed Oct. 10, 2001.

FIELD OF INVENTION

The present invention relates to lubricant compositions and more particularly to biodegradable lubricants compositions especially useful as gear oils.

BACKGROUND OF INVENTION

Commercially available lubricant compositions are prepared from a variety of natural and synthetic base stocks combined with various additive packages and solvents depending upon their intended application.

For lubricant applications requiring biodegradability of the lubricant base stock natural and synthetic ester base stocks have been extensively investigated. As might be expected no one ester will meet all of the major criteria specified for biodegradable lubricants. For example, one natural ester base stock in current use today is rapeseed oil which has very good biodegradability but poor low temperature properties and stability thus limiting its usefulness. An example of synthetic ester basestocks in current use are neopolyol esters formed by the esterification of neopolyols with mono- or dicarboxylic acids. For a given combination of neopolyol(s) and acid or acids there is a set of product properties that includes those such as viscosity, viscosity index, molecular weight, pour point, stability, demulsibility, and biodegradability, to mention just a few.

In those applications requiring biodegradable base stocks often it is also required that the lubricant additive employed with the base stock be substantially non-toxic. This is especially true if the lubricant composition is used on or near water or where it could possibly leak into the soil. Unfortunately many lubricant additives have poor environmental characteristics.

Experience has shown that most environmental type, gear oils are either biodegradable and non-toxic with poor performance in terms of gear protection and oil life, or they have good functional performance but lack the desired environmental characteristics. Thus, there is a need for a gear oil composition that has improved functional performances while maintaining low aquatic toxicity and biodegradability.

Accordingly, one object of the present invention is to provide improvements in gear performance of biodegradable non-toxic gear oils.

Another object of the present invention is to provide a gear oil composition that has balanced performance such as, for example, good rust inhibition without comprising FZG scuffing test performance.

These and other objects of the invention will become apparent from the description set forth below.

SUMMARY OF INVENTION

A biodegradable lubricating oil composition comprising:

(A) a major amount of a synthetic alcohol ester basestock formed by from the reaction product of:

(1) mono- and dipentaerythritol and (2) mixed acids comprising about 2 to 40 mole % linear mono carboxylic acids having from about 5 to about 12 carbon atoms, about 30 to about 70 wt % of a branched mono carboxylic acid having from about 15 to about 20 carbon atoms and from about 20 to about 30 mole % of a dicarboxylic acid or anhydride of a dicarboxylic acid having from about 4 to about 8 carbon atoms wherein the basestock has a viscosity at 100° C. in the range of about 20 to about 50 cSt at 100° C. and a pour point of less than about −20° C.; and (B) an effective amount of a polyoxyalkylene alcohol demulsifying agent, a combination of alkylated organic acid and ester thereof and ashless succinimide rust inhibitors and an ashless dithiocarbamate antiwear and extreme pressure agent.

DETAILED DESCRIPTION OF THE INVENTION

The synthetic alcohol ester basestock used in the gear oils of the present invention is preferably formed from the reaction of mono- and dipentaerythritol and mixed acids. Typically the mole ratio of mono- to dipentaerythritol used is in the range of 80:20 to about 99.9:0.1.

The mixed acids employed in forming the esters comprises about 2 to 40 mole % linear mono carboxylic acids having from about 5 to about 12 carbon atoms, about 30 to about 70 wt % of a branched mono carboxylic acid having from about 10 to about 25 carbon atoms, preferably 15 to about 20 carbon atoms and from about 20 to about 30 mole % of a dicarboxylic acid having from about 4 to about 8 carbon atoms.

The synthetic esters are formed by reacting the mono- and dipentaerithritol with the mixed acids under conventional esterification conditions well known in the art. See for example, the Encyclopedia of Chemical Technology, Fourth Edition, Volume 9, pages 755–812 and the references cited therein.

The esters used in the compositions of the invention will have a viscosity in the range of about 20 to about 50 cSt at 100° C. and a pour point of less than about −35° C.

In an alternate embodiment a blend of esters formed as set forth above may also be used in formulation the gear oils of the invention.

Indeed in one embodiment two esters are used. One is the reaction product of (1) mono- and dipentaerythritol and (2) mixed acids comprising 30 to 40 mole % of $C_7$ to $C_{10}$ linear acids, from 24 to 28% of a dicarboxylic acid having 5 to 7 carbon atoms and from 34 to 40 mole % of a branched acid having 17 to 19 carbon atoms. The other is the reaction product of (1) above and (2) mixed acids comprising 2 to 6 mole % of $C_7$ to $C_{10}$ linear acids, form 25 to 29 mole % of a dicarboxylic acid and from 65 to 70 mole % of a branched acid having 17 to 19 carbon atoms.

The lubricant compositions of the invention are formed by blending the ester base stock together with at least an effective amount of a polyoxy-alkylene alcohol demulsifying agent, an ashless dithiocarbamate antiwear and extreme pressure agent, and a combination of alkylated organic acid and ester thereof and ashless succinimide rust inhibitors.

A suitable polyoxyalkylene alcohol demulsifying agent is characterized by the formula

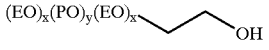

where EO is ethylene oxide moiety and PO is propylene oxide moiety, x and y represent the relative amounts of each.

A preferred demulsifying agent will have a MW in the range of about 1700 to 3000 and an EO/PO ratio of from about 20/80 to about 1/99. Typically the polyoxyalkene alcohol demulsifying agent is dissolved in a solvent such as tricrylphosphate (TCP). Especially useful is a solution comprising from about 85 to 95 wt % TCP.

A suitable ashless dithiocarbamate antiwar and extreme pressure is characterized by the formula

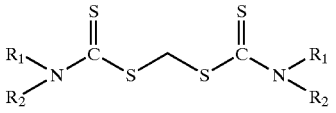

where $R_1$ and $R_2$ may be the same or different alkyl groups of from 1 to about 12 carbon atoms and preferably $R_1$ and $R_2$ are the same and have four carbon atoms.

Among suitable alkylated organic acids and esters thereof specific mention is made of alkylated succinic acid and esters thereof and especially tetra propenyl succinic acid and the monoester thereof where R is the monoester moiety, —COOR, is a $C_1$ to $C_4$ hydrocarbyl group. A mixture of about 70 wt % of the tetrapropenyl succinic acid and less than about 30 wt % of the ester is available as LZ 859 from Lubrizol Corporation, Wickliffe, Ohio.

Among suitable ashless succinimides known in the art specific mention is made of the reaction product of tetrapropenyl succinic anhydride and the intermediate product of oleic acid with triethyl amine. Such ashless succinimides are sold under the trade name Hitec 537 by Ethyl Corp., Richmond, Va. and under the trade name RT70B by ExxonMobil Chemical Company, Houston, Tex.

The composition of the invention may include other optional additives.

Preferably the additives listed in Table 1 are used in amounts sufficient to provide the normal function. Typical amounts for individual components are also set forth in the table. The balanced performance is achieved by carefully selecting the additives in the proper proportions to attain all of the necessary performance objectives.

TABLE 1

| | (Broad) wt % | (Preferred) wt % |
|---|---|---|
| Ashless dithiocarbamate in TCP antiwear/extreme pressure additive | 0.3–2.5 | 1.0–1.4 |
| Metal passivator (N- or N,S- heterocyclic) | 0.05–0.20 | 0.08–0.15 |
| Demulsifying agent (polyoxyalkylene alcohol in TCP solvent) | 0.03–0.30 | 0.05–0.18 |
| Antirust agents (one or more: imidazoline, succinic acid half ester, succinimide) | 0.03–0.35 | 0.10–.25 |
| Ashless phosphorus antiwear agents | 0.20–2.5 | 0.30–1.00 |
| Antioxidant(s) | 0.10–0.50 | 0.15–0.20 |
| Defoamant concentrate | 0.10–1.00 | 0.35–0.70 |
| Base stock | >90% | >90% |

EXAMPLE 1

A synthetic alcohol ester was prepared by esterifying a pentaerythritol composition and a mixed acid composition at 212 to 218° C. until TAN<0.5. The pentaerythritol and acid compositions are given in Table 2.

When TAN<0.5 was reached the reaction mixture was stripped at 212–218° C./10 mm Hg. The remaining product was treated with activated charcoal and water and then stripped at 95° C./10–20 mm Hg for 1 to 2 hours.

The product had the properties shown in Table 3.

EXAMPLE 2

The procedure of Example 1 was followed using the acids and alcohols shown in Table 2.

The product had the properties shown in Table 3.

TABLE 2

| Acid Composition, approximate mole % | Example 1 | Example 2 |
|---|---|---|
| $nC_7$ | 19% | 2% |
| $nC_8$ | 11% | 1% |
| $nC_{10}$ | 8% | 1% |
| Adipic acid | 25% | 27% |
| Isostearic acid | 37% | 69% |
| Alcohol composition, mole % | | |
| monopentaerythritol | 99.3% | 91% |
| dipentaerythritol | .7% | 9% |

TABLE 3

| Physical Properties | Example 1 | Example 2 |
|---|---|---|
| Viscosity at 100° C. | 26.6 cSt | 42.8 cSt |
| Viscosity at 40° C. | 270 cSt | 488 cSt |
| TAN | 1 | 1 |
| Pourpoint, ° C. | −33 | −24 |

COMPARATIVE EXAMPLE 3

A series of gear oils were formulated having the compositions shown in Table 4.

TABLE 4

| | | Wt % | | |
|---|---|---|---|---|
| | | A | B | C |
| Extreme Pressure | Sulfurized isobutylene | 1.38 | 1.40 | 1.40 |
| Antiwear | Amine phosphate/ N-heterocycle complex | 0.58 | 0.60 | 0.60 |
| Metal passivator/ antiwear | N-heterocycle | 0.12 | 0.15 | 0.15 |
| Metal passivator | N- or N,S-heterocycle | 0.05 | 0.05 | 0.05 |
| Antioxidant | Hindered phenol and/or aromatic amine | 0.50 | 0.50 | 1.50 |
| Demulsifier | Polyoxyalkylene alcohol in TCP solvent | — | 0.10 | — |
| Defoamant concentrate | polysiloxane and/ or polyacrylate in kerosene solvent | 0.10 | 0.50 | 0.50 |
| Base stock | Example 2 | 97.22 | 96.65 | 95.75 |
| TOTAL | | 100 | 100 | 100 |

EXAMPLE 3

A series of gear oils were formulated having the compositions shown in Table 5.

TABLE 5

| Component Function | Chemical Type | Wt % D | E | F |
|---|---|---|---|---|
| Antiwear/EP | ashless dithiocarbamate | 1.2 | 1.2 | 1.2 |
| Demulsifier | Polyoxyalkylene alcohol in TCP solvent | .15 | .15 | .15 |
| Rust inhibitor | Ashless succinimide | .10 | .10 | .10 |
| Rust inhibitor | Ashless alkylated succinic acid and esters thereof | .10 | .10 | .10 |
| Antiwear | Phosphorus anti-wear additives | 0.75 | 0.75 | 0.75 |
| Antioxidant(s)/ metal passivator(s)/ defoamant | Various | 0.76 | 0.76 | 0.76 |
| Base stock | Di-isotridecyl adipate | 3.0 | — | — |
| Base stock | Example 1 | 93.94 | 53.47 | — |
| Base stock | Example 2 | — | 43.47 | 96.94 |

COMPARATIVE EXAMPLE 4

The performance characteristics for the formulations A, B and C of Comparative Example 3 were measured and are given in Table 6.

TABLE 6

| Properties | Requirements | Results A | B | C |
|---|---|---|---|---|
| Biodegradability | 80% minimum in CEC L-33 | | | 96 |
| Aquatic toxicity | LL50 = 1 > 1000 ppm in rainbow trout test | | | 1,184 |
| KV @ 40° C. (D445-3) | | 147.9 | 434.1 | 417.5 |
| KV @ 100° C. (D445-5) | | 18.25 | 37.26 | 35.86 |
| Copper corrosion, ASTM D130, 24 hours @ 121° C. | 2B maximum | | 4A | 4C |
| Pour Point, ° C. | −30° maximum | <35° | | |
| ASTM Rust, distilled water/ synthetic sea water | pass/pass | pass/pass | pass/pass | pass/pass |
| Bethlehem Steel Rust, A/B/C | pass/pass/ pass | pass/pass/ fail (severe) | pass/pass/ fail (severe) | pass/pass/ pass |
| Demulsibility (D1401) time to 37 ml water | 10 typical | >60 typical | 5 typical | |
| FZG scuffing fail stage | 12+ minimum | 13+ | 13+ | 13+ |

EXAMPLE 4

The performance characteristics for the formulations D, E and F of Example 3 were measured and are given in Table 7.

As can be seen, compositions A, B and C of Table 4 meet some, but not all of the requirements for commercially acceptable gear oils. The biodegradability and aquatic toxicity for those oils are acceptable. The oils also meet the FZG Scuffing Test requirement, but they fail to meet the rust and corrosion requirements needed to protect gears and bearings, especially those operating in potentially wet environments. The compositions D, E and F of Table 5 meet all of the requirements, including biodegradation, aquatic toxicity and FZG Scuffing Test, as well as copper corrosion protection and rust inhibition.

TABLE 7

| Properties | Requirements | Results D | E | F |
|---|---|---|---|---|
| Biodegradability | 80% minimum in CEC L-33 | 87 | 90 | 92 |
| Aquatic toxicity | LL50 = 1 > 1000 ppm in rainbow trout test | 1898 | 3185 | >5013 |
| KV @ 40° C. (D445-3) | | 227.8 | 322.2 | 444.6 |
| KV @ 100° C. (D445-5) | | 23.36 | 30.18 | 37.53 |
| Copper corrosion, ASTM D130, 24 hours @ 121° C. | 2B maximum | 2A | 2A | 2A |
| Pour Point, ° C. | −30° maximum | −39 | −33 | −30 |
| ASTM (D665) rust, distilled water/ synthetic sea water | pass/pass | pass/pass | pass/pass | pass/pass |
| Bethlehem Steel Rust, A/B/C | pass/pass/pass | pass/pass/ pass | pass/pass/ pass | pass/pass/ pass |
| Demulsibility (D1401) time to 37 ml water | 10 typical | 20 | 10 | 5 |
| FZG scuffing fail stage | 13+ | 13+ | 13+ | 13+ |

What is claimed is:

1. A biodegradable lubricating oil composition comprising:

(A) a major amount of one or more biodegradable synthetic alcohol ester basestocks formed from the reaction product of:

(1) mono- and dipentaerythritol and (2) mixed acids comprising about 2 to 40 mole % linear monocarboxylic acids having from about 5 to about 12 carbon atoms, about 30 to about 70 wt % of a branched monocarboxylic acid having from about 15 to about 20 carbon atoms and from about 20 to about 30 mole % of a dicarboxylic acid having from about 4 to about 8 carbon atoms wherein the basestock has a viscosity at 100° C. in the range of about 20 to about 50 cSt at 100° C. and a pour point of less than about −20° C.; and (B) an effective amount of a polyoxyalkylene alcohol demulsifying agent, an ashless dithiocarbamate antiwear and extreme pressure agent, and a combination of alkylated organic acids and esters thereof and ashless succinimide rust inhibitors.

2. The composition of claim 1 wherein the demulsifying agent is a solution having from about 85 to 95 wt % solvent and the solution of demuslifying agent is from 0.03 to 0.30 wt % of the composition, the combination of rust inhibitors is from 0.03 to 0.35 wt % and the antiwear and extreme pressure agent is from 0.3 to 2.5 wt % of the composition.

3. The composition of claim 2 wherein the mixed acid comprise 30 to 40 mole % of $C_7$ to $C_{10}$ linear acid, from 24 to 28° C. of a dicarboxylic acid having 5 to 7 carbon atoms and from 34 to 40 mole % of a branched acid having 17 to 19 carbon atoms.

4. The composition of claim 2 wherein the mixed acids comprise 2 to 6 mole % of $C_7$ to $C_{10}$ linear acids, from 25 to 29 mole % of a dicarboxylic acid and from 65 to 70 mole % of a branched acid having 17 to 19 carbon atoms.

5. The composite of claim 3 including a second alcohol ester formed from the reaction product of (i) mono- and dipentaerythritol and (ii) mixed acids comprising 2 to 6 mole % of $C_7$ to $C_{10}$ linear acids from 25 to 29 mole % of a dicarboxylic acid and from 65 to 70 mole % of a branched acid having 17 to 19 carbon atoms.

6. The composition of any one of claims 1 to 4 wherein the ratio of mono- to dipentaerythritol is in the range of 80:20 to 99.9:0.1.

7. The composition of claim 2 wherein the composition includes a rust inhibitor, metal passivator, antifoamant, extreme pressure additive, antiwear additive and antioxidant.

8. The composition of claim 7 wherein, based on the total weight of the composition, (i) the rust inhibitors are present in an amount of from 0.03 to 0.30 wt % and is selected from the group consisting of imidazolines, succinic acid half esters, succinimide and mixtures thereof, (ii) the metal passivator is present in an amount of form 0.05 to 0.20 wt % and is selected from the group consisting of N and N and S heterocyclic metal passivators, (iii) the antioxidant is a mixture of phenyl amines and tolyltriazoles and is present in an amount of from 0.10 to 0.50 wt %, and (iv) the antifoamant is selected from polysiloxanes and polyacrylates in kerosene solvent and is present from 0.10 to 1.0 wt %.

9. A lubricant composition comprising:

(A) greater than 90 Wt % based on the total weight of the composition of a synthetic ester basestock having a viscosity at 100° C. in the range of about 2 to 50 cSt and a pour point of less than −30° C.; and formed from (i) the reaction product of (1) mono- and dipentaerythritol and (2) mixed acids comprising 30 to 40 mole % of $C_7$ to $C_{10}$ linear acid, from 24 to 28% of a dicarboxylic acid having 5 to 7 carbon atoms and from 34 to 40 mole % of a branched acid having 17 to 19 carbon atoms;

(ii) the reaction product of (1) mono- and dipentaerythritol and (2) mixed acids comprising 2 to 6 mole % of $C_7$ to $C_{10}$ linear acids, from 25 to 29 mole % of a dicarboxylic acid and from 65 to 70 mole % of a branched acid having 17 to 19 carbon atoms; and (B) based on the total weight of the composition from 0.03 to 0.30 wt % of a polyoxyalkylene alcohol demulsifier solution having from 85 to 95 wt % TCP, and from 0.3 to 2.5 wt % of an ashless dithiocarbamate antiwear and extreme pressure agent, from 0.03 to 0.35 wt % of a combination of alkylated organic acid and esters thereof and ashless succinimide rust inhibitors.

10. The composition of claim 9 wherein, based on the total weight of the composition, (i) the rust inhibitor is present in an amount of from 0.03 to 0.30 wt % and is selected from the group consisting of imidazolines, succinic acid half esters, succinimide and mixtures thereof, (ii) the metal passivator is present in an amount of form 0.05 to 0.20 wt % and is selected from the group consisting of N and N and S heterocyclic metal passivators, (iii) the antioxidant is a mixture of phenyl amines and tolyltriazoles and is present in an amount of from 0.10 to 0.50 wt %, and (iv) the antifoamant is selected from polysiloxanes and polyacrylates and is present from 0.10 to 1.0 wt %.

* * * * *